US009107014B2

(12) United States Patent
Tang

(10) Patent No.: US 9,107,014 B2
(45) Date of Patent: Aug. 11, 2015

(54) MULTIFUNCTIONAL EARPHONE

(71) Applicant: Qi Tang, Shenzhen (CN)

(72) Inventor: Qi Tang, Shenzhen (CN)

(73) Assignee: AAC TECHNOLOGIES PTE, LTD., Singapore (SG)

( * ) Notice: Subject to any disclaimer, the term of this patent is extended or adjusted under 35 U.S.C. 154(b) by 0 days.

(21) Appl. No.: 14/293,026

(22) Filed: Jun. 2, 2014

(65) Prior Publication Data

US 2014/0355791 A1 Dec. 4, 2014

(30) Foreign Application Priority Data

Jun. 3, 2013 (CN) ..... 2013 1 0217961

(51) Int. Cl.
*H04R 25/00* (2006.01)
*H04R 17/02* (2006.01)
*H04R 1/10* (2006.01)

(52) U.S. Cl.
CPC ..... *H04R 25/606* (2013.01); *H04R 1/1016* (2013.01); *H04R 17/02* (2013.01); *H04R 1/1083* (2013.01); *H04R 2460/13* (2013.01)

(58) Field of Classification Search
CPC .. H04R 25/606; H04R 17/02; H04R 2460/13; H04R 1/14; H04R 1/46; H04R 1/1016; H04R 11/02; H04R 11/04
USPC ..... 381/150, 151, 312, 322, 326; 600/25; 607/55, 57
See application file for complete search history.

(56) References Cited

U.S. PATENT DOCUMENTS 5,778,079 A * 7/1998 Wun ..... 381/326
2010/0246860 A1* 9/2010 Rye et al. ..... 381/151

* cited by examiner

*Primary Examiner* — Matthew Eason
(74) *Attorney, Agent, or Firm* — IPro, Inc.; Na Xu

(57) ABSTRACT

A multifunctional earphone is disclosed. The multifunctional earphone includes a main body having an electroacoustic element incorporated therein for serving as an earphone, an ear-insertion body having a sound tube portion bonded with the main body, a wing portion extending around from the sound tube portion, and an acceleration sensor serving as a microphone embedded in the wing portion and formed a configuration such that the outer periphery of the wing portion contacts an external auditory meatus of a user's ear. The acceleration sensor includes a substrate directly or indirectly contacting with a vibration source, a spring connecting with the substrate, a weight and a piezoelectric element deformed by an external force from the weight, by which the piezoelectric element produces an electric energy based on piezoelectricity effect.

3 Claims, 2 Drawing Sheets

MULTIFUNCTIONAL EARPHONE

RELATED PATENT APPLICATIONS

This application claims the priority benefit of Chinese Patent application Filing Serial Number CN 201310217961.3, filed on Jun. 3, 2013, the disclosures of which are herein incorporated by reference in its entirety.

FIELD OF THE INVENTION

The present disclosure relates to transmitting/receiving transducers used in handheld devices, and more particularly to a multifunctional earphone used in a mobile phone.

DESCRIPTION OF RELATED ART

When communicating through a communication apparatus such as a handheld phone, cordless phone or transceiver, a user desires to freely use hands to write a memorandum, to refer to notes, or to operate a personal computer. For satisfying this need, a headset has been proposed which comprises a headphone and a microphone supported by a support bar in front of the user's mouth.

The headset enables the hand-free use. However, it is difficult to transmit clear voice to the communication counterpart when the headset is used in a noisy place, for example, in a plant or vehicle, because the microphone of the headset also catches noise.

Conventionally, the microphone to which bone conduction was applied in various fields, such as a cellular phone, a medical field, and armaments industry, is used. Usually, as for the mechanism in which human being perceives a sound, the oscillating pressure of the air produced from a sound source transmits vibration as a signal to a brain via the auditory nervous system etc. which vibrate the eardrum which exists in a middle ear and participate in an acoustic sense. Thus, the sound perceived is called air conduction sound.

On the other hand, bone conduction contacts a head in a vibrator and makes a sound perceive by vibrating some skulls. This is called a bone conduction sound. A bone conduction sound differs in the transmission mechanism of an air conduction sound and a sound as mentioned above. Then, when it is hard to catch a sound in the surrounding noise, or when a sound cannot be easily heard for some obstacles of the organ which manages acoustic senses, such as the eardrum, a microphone, a speaker, etc. using bone conduction become useful.

The conventional bone conduction microphone fixes a bone conduction microphone unit portion to a throat part with a neck band or an arm, or, It fixes at the tip of a head strap and a headset, and the tip of the arm attached previously, and it presses by a lateral pressure, or it has a portion of a bone conduction microphone unit in a jugal, tempora, etc. by hand, it is pressed against them, and it is used for the telephone call in the form where it is not affected as much as possible by the influence of the surrounding noise.

However, the arm for exclusive use, the neck band, and the head strap were required for the conventional bone conduction microphone in order to press the bone conduction microphone unit against a bone conduction portion with sufficient sound conduction efficiency. Therefore, in order to equip, time and effort was taken and it was interfered in many cases. Even when using with headphone etc. in common, headphone and the bone conduction microphone had to be set independently and were complicated.

Therefore, it is necessary to provide a new multifunctional earphone for solving the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the embodiment.

DETAILED DESCRIPTION OF THE EMBODIMENT

Reference will now be made to describe the exemplary embodiment of the present invention in detail.

Figure 1:
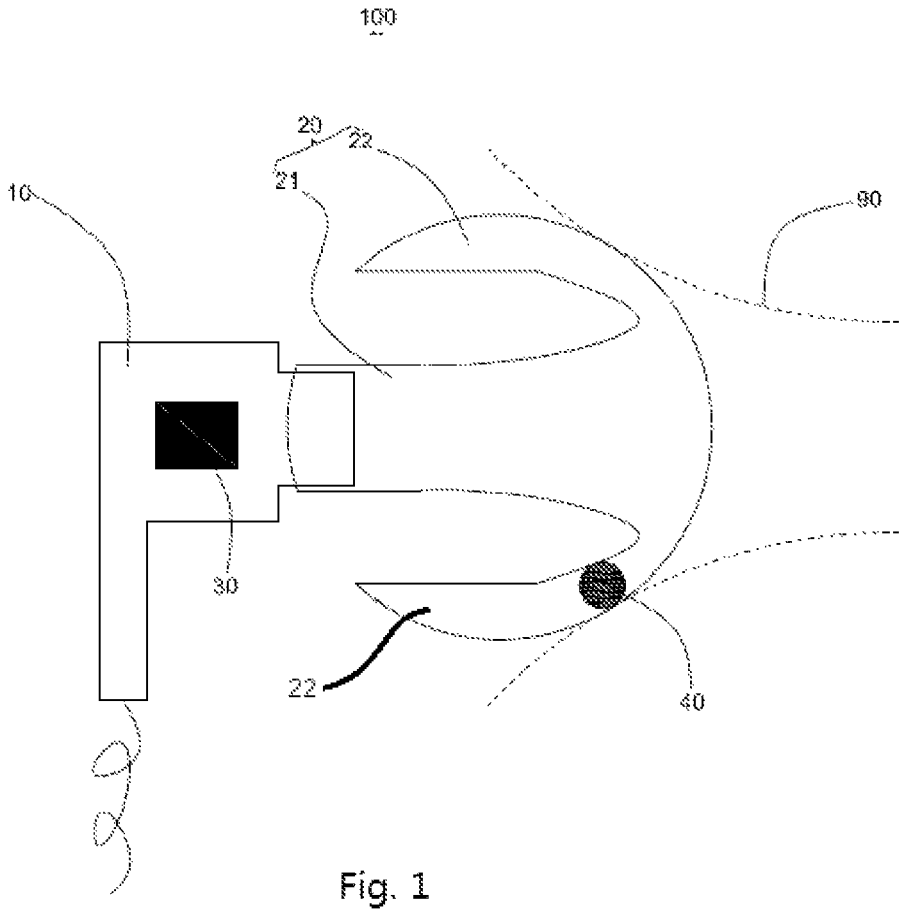
FIG. 1 is a schematic cross-sectional view of a multifunctional earphone in accordance with an exemplary embodiment of the present disclosure.
Figure 2:
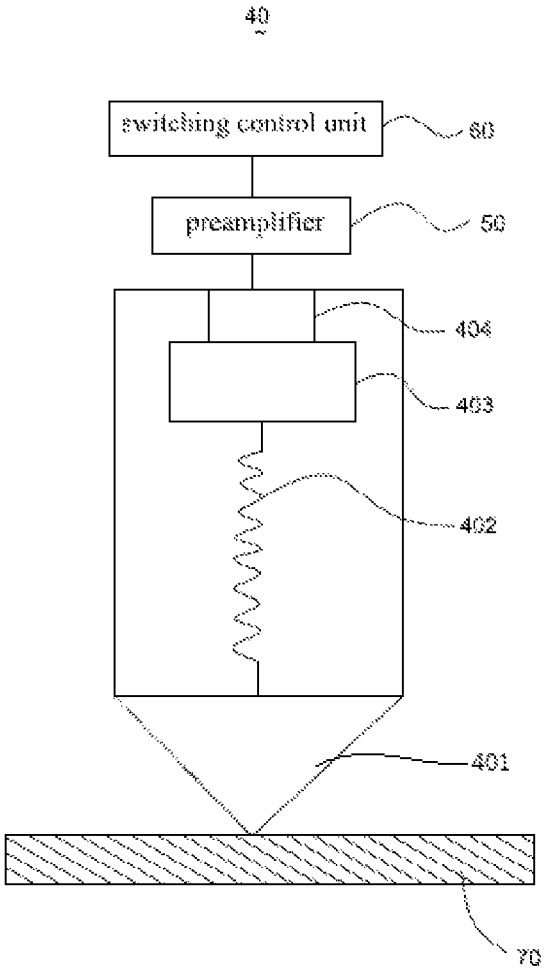
FIG. 2 is an isometric illustrative view of an acceleration sensor of the earphone shown in FIG. 1.

Referring to FIGS. 1 through 2, a multifunctional earphone 100 includes a main body 10 having an electroacoustic element 30 incorporated therein for serving as an earphone, and an ear-insertion body 20 having an acceleration sensor 40 serving as a microphone positioned toward an ear canal when positioned at the user's ear. The electroacoustic element 30 and the acceleration sensor 40 are able to electrically connect to external circuit via a wire, respectively.

Specifically, the ear-insertion body 20 includes a sound tube portion 21 formed of a synthetic resin bonded with the main body 10, a wing portion 22 extending around from the sound tube portion 21 and formed of a relatively rigid resin from silicone resins or polyvinylchloride resins into a configuration such that the outer periphery thereof contacts an external auditory meatus 90 of a user's ear. The acceleration sensor 40 is embedded in the wing portion 22 for detecting a vibrating signal and converting it into electric signal thereby severing as the bone-conduction microphone.

FIG. 2 is a schematic view illustrating one example of the acceleration sensor 40 serving as the bone-conduction microphone. As shown, the acceleration sensor 40 includes a substrate 401, a spring 402, a weight 403 and a piezoelectric element 404. When working, one end of the substrate 401 directly or indirectly contacts with a vibration source 70, the other end connects to the weight 403 via the spring 402. The substrate 401 is capable of feeding back a signal from a vibration signal of the vibration source 70 to the weight 403. The weight 403 will be vibrated responding to the vibration signal of the vibration source 70 in a proper frequency range so as to cause the piezoelectric element 404 to deform by an external force from the weight 403, thereby the piezoelectric element 404 producing an electric energy based on piezoelectricity effect. The electric energy is decoded and converted into an audio signal for external circuit consumption. In the embodiment, a natural frequency of the acceleration sensor 40 is about 8 KHz. The vibration frequency of the vibration source 70 is much less than a natural frequency of the acceleration sensor 40. The electric energy will thus be proportional to a force of the vibration source 70. That is to say, the electric energy of the piezoelectric element 404 varies with an acceleration of the acceleration sensor 40.

In the embodiment, the spring 402 and the weight 403 is designed as an elastic system which has a free oscillation frequency $f_0$ obtained by the following formula:

$$f_0 = \frac{1}{2\pi}\sqrt{\frac{1}{MC}}$$

Here, M is the weight of the weight 403; C is compliance coefficient of the spring 402.

When a vibration frequency of the vibration source 70 is less than the free oscillation frequency $f_0$ of the elastic system, the acceleration sensor 40 is kept in proper state. If the vibration source 70 generates a vibration frequency in a constant frequency range, the piezoelectric element 404 will output a voltage Ea which is obtained by the following formula:

$$E_a = \tau\frac{Ma_{10}}{\omega|Z_m|}$$

Here, M is weight of the weight 403, $\alpha_{10}$ is an acceleration of the acceleration sensor 40, $\tau$ is a constant, $Z_m$ is a mechanical impedance of the piezoelectric element 404, and $\omega$ is the vibration frequency of the vibration source 70.

When a vibration frequency of the vibration source 70 source is less than the free oscillation frequency $f_0$, the voltage Ea of the piezoelectric element 404 may be approximately calculated by another formula as follows:

$$E_a = \frac{\tau a_{10}}{f_0^2}$$

Here, $\alpha_{10}$ is an acceleration of the acceleration sensor 40, $\tau$ is a constant.

In use, the multifunctional earphone comprises the electroacoustic element 30 serving as an earphone and the acceleration sensor 40 serving as a bone-conduction microphone, which all are inserted into an ear. A frequency band of a speaker's voice is less than the natural frequency of the acceleration sensor 40, and is less than the free oscillation frequency $f_0$ of the elastic system. Thus, the multifunctional earphone of the present disclose achieves the transmission and reception of audio information.

Furthermore, the multifunctional earphone 100 further includes a preamplifier 50 used for enhancing the electric energy of the acceleration sensor 40, and a switching control unit 60 configured to control the work mode of the acceleration sensor 40. Specifically, when using the earphone to make a call, the switching control unit 60 controls the acceleration sensor 40 severing as a microphone to receive a voice signal.

Although, the multifunctional earphone 100 according to the foregoing embodiment is designed to be used with a handheld phone, they can also be effectively used with an ordinary stationary telephone or a transceiver. In addition, it is possible to use ultrasonic waves instead of radio waves as transmitting medium, without causing any disadvantage. Therefore, the multifunctional earphone 100 frees user's hands, and does not cause such problems as howling and crosstalk. In addition, the user can comfortably use the multifunctional earphone 100 without feeling pressure on the throat. The acceleration sensor 40 as the vibration sensor has excellent frequency characteristics, thereby permitting clear voice to be received and transmitted. Thus, the multifunctional earphone 100 of the present disclosure offers great practical advantages.

While the present invention has been described with reference to a specific embodiment, the description of the invention is illustrative and is not to be construed as limiting the disclosure. Various of modifications to the present invention can be made to the exemplary embodiment by those skilled in the art without departing from the true spirit and scope of the disclosure as defined by the appended claims.

What is claimed is:

1. A multifunctional earphone, comprising:

a main body having an electroacoustic element incorporated therein for serving as an earphone;

an ear-insertion body having a sound tube portion bonded with the main body, a wing portion extending around from the sound tube portion, and an acceleration sensor serving as a microphone embedded in the wing portion and formed a configuration such that the outer periphery of the wing portion contacts an external auditory meatus of a user's ear;

the acceleration sensor including a substrate directly or indirectly contacting with a vibration source, a spring connecting with the substrate, a weight and a piezoelectric element deformed by the weight, thereby the piezoelectric element producing an electric energy based on piezoelectricity effect;

a switching control unit configured for controlling work modes of the acceleration sensor.

2. The multifunctional earphone as described in claim 1 further including a preamplifier used for enhancing the electric energy of the acceleration sensor.

3. The multifunctional earphone as described in claim 2, wherein a natural frequency of the acceleration sensor is about 8 KHz.

* * * * *